US005124220A

United States Patent [19]

Brown et al.

[11] Patent Number: 5,124,220

[45] Date of Patent: Jun. 23, 1992

[54] BILAYER TOPCOATS FOR ORGANIC PHOTOCONDUCTIVE ELEMENTS

[75] Inventors: David E. Brown, St. Paul; Susan K. Jongewaard, North St. Paul; Roger I. Krech, St. Paul, all of Minn.; Gregory L. Zwadlo, Ellsworth, Wis.

[73] Assignee: Minnesota Mining and Manufacturing Company, St. Paul, Minn.

[21] Appl. No.: 515,240

[22] Filed: Apr. 27, 1990

[51] Int. Cl.[5] ..... G03G 5/147

[52] U.S. Cl. ..... 430/67; 430/126

[58] Field of Search ..... 430/66, 67, 42

[56] References Cited

U.S. PATENT DOCUMENTS 4,565,760 1/1986 Schank ..... 430/67
4,600,669 7/1986 Ng et al. ..... 430/47
4,600,673 7/1986 Hendrickson et al. ..... 430/66
4,658,756 4/1987 Ito et al. ..... 430/67
4,804,602 2/1989 Buettner et al. ..... 430/42

OTHER PUBLICATIONS

Research Disclosure 10942, "Multilayer Electrographic Elements".

*Primary Examiner*—John Goodrow
*Attorney, Agent, or Firm*—Gary L. Griswold; Walter N. Kirn; Mark A. Litman

[57] ABSTRACT

The use of a barrier layer between photoconductor layers and release layers in electrographic imaging materials provides enhanced performance, particularly in multiple use of the imaging materials in liquid toned imaging processes.

19 Claims, No Drawings

BILAYER TOPCOATS FOR ORGANIC PHOTOCONDUCTIVE ELEMENTS

BACKGROUND OF THE INVENTION

1. Field of the Invention

The present invention relates to organic photoconductive layers and specifically the protection of those layers and the extension of their useful life in imaging processes.

2. Background of the Art

Multicolor toner images produced by successive toner transfer from a photoconductor to a single receptor are well known in the art both for powder toners with constituents intended to improve resolution on transfer and for use with magnetic brush development (U.S. Pat. No. 3,833,293). U.S. Pat. No. 3,612,677 discloses a machine designed to provide good registration when using successive color image transfer, and U.S. Pat. No. 3,804,619 discloses special powder toners to overcome difficulties toners have in 3 color successive transfer.

The production of multi-colored images by overlaying toned images on a photoconductor surface is also known. Thus U.S. Pat. No. 3,337,340 discloses liquid developers designed to minimize the "bleeding away of charge on the photoconductor surface" which occurs when recharging of an already toned surface is attempted. U.S. Pat. No. 4,155,862 and U.S. Pat. No. 4,157,219 disclose liquid toner formulations and apparatus for producing multicolor composite toned images on a photoconductor surface. U.S. Pat. No. 4,275,136 emphasizes the difficulties in ensuring that overlaid toner layers on a photoconductor adhere to one another. The addition of zinc or aluminum hydroxides coated on the colorant particles is used to solve the problem. No transfer of composite images is disclosed in these references.

Many methods are used to aid the efficient transfer of toner from a photoconductor surface after toner development to a receptor sheet. U.S. Pat. No. 3,157,546 discloses overcoating a developed toner image while it is still on the photoconductor. A liquid layer having a concentration of about 5% of a film-forming material in a solvent is used at between 10 and 50 microns wet thickness. After drying, transfer is carried out to a receptor surface which has a mildly adhesive surface. Defensive Publication T879,009 discloses a liquid toner image first developed on a photoconductor and then transferred to a receptor sheet whose surface is coated with a polymer layer easily softenable by residual solvent in the developed image which thus adheres the image to the receptor surface. U.S. Pat. No. 4,066,802 discloses the transfer of a multitoned image from a photoconductor, first to an adhesive carrier sheet, and then to a receptor. The second stage involves the application of heat and pressure with a "polymeric or plasticizing sheet" between the image on the carrier sheet and the receptor surface. U.S. Pat. No. 4,064,285 also uses an intermediate carrier sheet which has a double coating on it comprising a silicone release layer underneath and a top layer which transfers to the final receptor with the multicolor image and fixes it under the influence of heat and pressure. U.S. Pat. No. 4,337,303 discloses methods of transferring a thick (high optical density) toned image from a photoconductor to a receptor. High resolution levels of the transferred images are claimed (200 1/mm). It is required to dry the liquid toned image and encapsulate the image in a layer coated on the receptor. Curing of the encapsulating layer is required with some formulations. The materials of this layer are chosen to have explicit physical properties which provide not only complete transfer of the thick toner image but also ensure encapsulation of it.

U.S. Pat. No. 4,477,548 teaches the use of a protective coating over toner images. The coating is placed on the final image and is not involved in any image transfer step. The coating may be a multifunctional acrylate, for example.

Transfer of certain types of composite multitoned images is disclosed in the art. U.S. Pat. No. 3,140,175 deposits microbeads containing a dye and a photoconductor on one electrode, exposes them through a colored original and then applies field between a first and second electrode causing separation of charged and uncharged beads and transfer of the colored image to a receptor surface at the second electrode. U.S. Pat. No. 3,376,133 discloses laying down different colored toners sequentially on a photoconductor which is charged only once. The toners have the same charge as that on the photoconductor and replace the charge conducted away in image areas. However, it is disclosed that subsequent toners will not deposit over earlier ones. The final image of several toners is transferred to a receptor and fixed. U.S. Pat. No. 3,862,848 discloses normal sequential color separation toned images transferred to an intermediate receptor (which can be a roller) by "contact and directional electrostatic field" to give a composite multitoned image. This composite image is then transferred to a final receptor sheet by contact and a directional electrostatic field.

U.S. Pat. No. 4,600,669 describes an electrophotographic proofing element and process in which successive liquid toned color images are formed on a temporary photoconductive support. The composite image is then transferred to a receptor layer. The photoconductive layer has a releaseable dielectric support coated thereon which may comprise a polymeric overcoat on the photoconductive layer which is transferred with the composite image.

U.S. Pat. No. 4,515,882 describes an electrophotographic imaging system using a member comprising at least one photoconductive layer and an overcoating layer comprising a film forming continuous phase of charge transport molecules and charge injections enabling particles.

Protective overcoating layers have been proposed for the purpose of enhancing the durability of electrophotographic photoreceptors. For example, the imaging surfaces of many photoconductive elements are sensitive to wear, humidity, ambient fumes, corona induced changes, scratches and deposits which adversely affect electrophotographic performance. In addition, auxillary layers designed to control specific properties such as light absorption or dark discharge rate have also been described. However, many of the overcoating layers adversely affect the electrophotographic responses of a photoreceptor construction. For example, when an electrically insulating top-coat is used, there is a tendency for a residual potential to remain on the photoconductive member after exposure where the intensity of this residual voltage increases with the thickness of the insulating coating. In many cases, this residual potential shows a tendency to increase as the photoreceptor is cycled, which can make the development process difficult to control. To minimize such problems, the insulating layer must be made extremely thin; but this can limit their efficiency since they are then easily damaged and subject to rapid wear. Attempts have been made to overcome these difficulties by the use of overcoats having higher levels of electrical conductivity, for example, by including quaternary ammonium salts in the topcoat. However, the conductivity of such layers is typically highly dependent on ambient moisture. Under very dry conditions, the conductivity of these layers may diminish to the extent that they show the same limitations as insulating materials. At high humidities, lateral charge migration can lead to loss of image resolution.

A further variety of overcoats for electrophotographic photoconductors involves the use of a layer having a low surface energy; the purpose of such a layer being to increase the efficiency of toner transfer from the surface of the photoreceptor. silicon and fluorocarbon polymers have been previously described as effective for this application. However, when such materials are solution coated, the solvent used can leach active materials from the OPC film resulting in adverse effects on both photoresponse and on the release properties of the topcoat. Moreover, such release films frequently require thermal "cure" at temperatures exceeding the glass transition temperature of the underlying OPC matrix during which materials from the photoconductor can migrate into the overcoated film.

U.S. Pat. No. 4,565,760 describes a photoresponsive imaging member comprising a photoconductor layer and, as a release protective coating over at least one surface, a dispersion of colloidal silica and a hydroxylated silsesquixone in alcohol medium.

U.S. Pat. No. 4,600,673 describes the use of silicone release coatings on photoconductive surface to increase the efficiency of toner transfer in electrophotographic imaging processes.

U.S. Pat. No. 4,721,663 describes an improved enhancement layer used in electrophotographic devices between a top protective layer and the photoconductor layer.

U.S. Pat. No. 4,752,549 describes an electrophotographic receptor having a protective layer consisting of a thermosetting silicone resin and a polyvinyl acetate resin. The combination provides improved densability.

U.S. Pat. No. 4,510,223 describes a multicolor electrophotographic imaging process. A general description of transfer of the toned image to an adhesive receptor is disclosed (column 15, lines 21–40).

U.S. Pat. Nos. 4,323,591; 4,306,954; 4,262,072; and 4,249,011 relate to polyacrylate materials having heterocyclic nuclei and processes for their cure into hard, solvent-resistant and abrasion-resistant films. These monomers are curable out of solvent-free compositions and can be cured by irradiation in air.

SUMMARY OF THE INVENTION

Photoconductive layers comprising an organic photoconductor composition are enhanced by the use of an organic polymeric barrier layer coating and then a release layer such as an organo-silicone polymeric release layer as a top coating.

The invention also describes a process by which the electrophotographic properties of a photoconductor can be maintained through multiple reuses in a process involving liquid toning and thermally assisted toner transfer steps.

The barrier layers described in this invention protect the essential properties of both the organic photoconductor (OPC) layer and the polymer release coating by preventing or inhibiting the transport of material between these layers both during the manufacture of the photoreceptor element and during its use within the electrophotographic process.

DESCRIPTION OF THE INVENTION

In order to have photoconductive elements provide multiple images or many different images, it is necessary for the element to retain its photoconductive properties and to have all toner material removed between each image formation. To improve removal of image toner as well as excess or residual toner from the photoconductor surface, it is possible to provide a release layer surface coating on the photoconductor. Organo-silicone release layers as used in this invention are described in U.S. Pat. No. 4,600,673.

These organo-silicone release layers are coated from hydrocarbon solvents and cured for several minutes at elevated temperatures. During these steps it has been found that materials from the organic photoconductor layer migrate into the silicone release coating by dissolution and/or thermally assisted migration processes. The presence of organic photoconductor materials within the release coating adversely affects the performance of the construction regarding its toning properties, especially during the initial image cycles. Also, in electrophotographic processes involving liquid toning and thermal transfer steps, such problems persist through successive image cycles by the leaching of materials from the organic photoconductor by toner solvents and/or the migration of toner and thermal adhesive film materials into the photoconductive layer. The overall effect of these processes is a progressive deterioration in both the photoresponse and image transfer properties of the construction.

The present invention provides a two layer surface coating on organic photoconductor layers to reduce these problems. The first layer, which is in contact with the surface of the organic photoconductor layer, is an organic polymeric barrier layer. The top most layer is a release layer, as such layers are known in the art.

Organic photoconductive materials are well known in the art, and the present invention is applicable to all such organic photoconductors. The preferred class of organic photoconductors includes poly(N-vinyl-carbazole) and bis-benzocarbazole compounds. The latter class is most preferred and is disclosed in U.S. Pat. Nos. 4,367,274; 4,361,637; 4,357,405; 4,356,244; and 4,337,305, for example. Electrophotographic layers of bis-5,5,'-(N-ethyl-benzo[a]carbazolyl)phenylmethane (hereinafter referred to as BBCPM) are most preferred.

The release layers are commercially available polymeric materials which are coated onto a surface to provide reduced adherence of other materials to that surface. Both silicone and non-silicone release layers are known in the art as represented by U.S. Pat. Nos. 3,342,625; 2,876,894; 3,328,482; 3,527,659; 3,891,745; 4,171,397 and 4,313,988. Preferred release layer materials in the practice of the present invention are the organo-silicone release layer materials.

The organic barrier layer may be formed from any organic film forming polymer which is different from said release layer material (and is itself preferably neither a release layer nor an organo silicone layer). Representative examples of polymers that can be used are acrylic materials (e.g., polyacrylamide and the acrylics of U.S. Pat. No. 4,262,072), cellulosic polymers (e.g., hydroxypropyl cellulose and methyl cellulose), and vinyl resins (e.g., polyvinyl alcohol, polyvinylpyrrolidone, methylvinylether/maleic anhydride copolymer, polyvinyl alcohol/maleic anhydride/methylvinylether 93/3.5/3.5 terpolymer). The layer is at best 0.02 micrometers and preferably between 0.02 and 1.0 micrometers in thickness (when dried).

The following is a general description of polymer materials useful as barrier layers in the current invention.

Particularly useful materials are polymers which are good barriers to gases such as oxygen and nitrogen. Useful barrier properties are provided by polymers possessing the following properties:

(a) polarity, preferably a level of polarity such as is conferred by hydroxyl, acrylic, ester or amide groups on a polymer in equivalent weights of less than 5,000, (b) high glass transition temperatures (>40° C.), (c) a degree of crosslinking or interchain attraction (preferably a degree of crosslinking in excess of 1.01), and (d) high chain stiffness.

In addition, the chosen material must be soluble in water, alcohol or water/alcohol mixtures to give solutions at least 0.1 percent by weight and preferably >1% by weight prior to coating. The resultant polymer coatings must also be transparent to optical and near infrared wavelengths and be optically clear (i.e., non-scattering).

In terms of oxygen permeability (where this is expressed in units of cubic cms./mil day 100 sq. in atm.), the chosen material should have a value of less than 100, preferably less than 10 and ideally less than 1.

The organic photoconductive layer may be a free standing sheet or may be a layer on a substrate. Many variations of these structures are known and are useful in the practice of the present invention. Typical electrophotographic elements comprise a support layer and the organic photoconductor layer. Often a conductive layer is used between the support layer and the photoconductor layer (although it can be on the backside of the support layer). Other intermediate or auxiliary layers are used to various advantages on these constructions. The various layers may contain additional materials needed to provide desirable properties to the individual layers or the articles. Dyes and pigments may be used for coloration, image ehnahcement, spectral sensitization, brightening, or the like. Surfactants, coating aids, slip agents, extenders, conductive polymers or particles, and the like are expected to be used in various electrographic or electrophotographic constructions. These and other aspects of the present invention may be understood from the following non-limiting examples.

Example 1

A photoconductive layer comprising 40 parts by weight of the charge transport material BBCPM (I), 59.3 parts by weight of Vitel TM PE-207 polyester resin (Goodyear) and 0.7 parts by weight of the heptamethine indocyanine dye (II) having a structure of the formula:

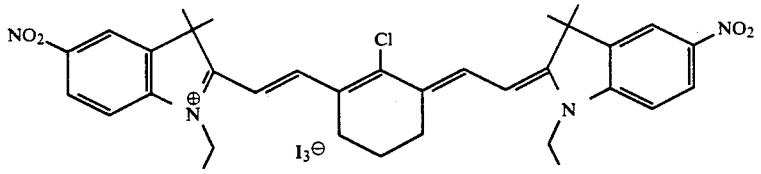

was prepared by solvent coating onto aluminized polyester film base. This composition (at a final dry coating thickness of ca. 7.5 micrometers) was used as the organic photoconductor (OPC) material in the following examples.

The standard silicone release coat used in these tests was Syl-Off TM 23 (Dow Corning) prepared, coated and cured as previously described in U.S. Pat. No. 4,600,673. The dry coating thickness of this silicone polymer was ca. 40 nm.

An intermediate layer of 1,3-bis(3-[2,2,2-(triaryloyloxymethyl)ethoxy-2-hydroxypropyl]-5,5-dimethyl-2,4 -imidizolidinedione (hereinafter "HHA") was coated from the following solutions:

| | |
|---|---|
| HHA in methylethyl ketone (30% solids) | 300 gm |
| Ethanol (Teagent grade-5% isopropanol) | 3700 gm |
| Irgacure TM 184 photoinitiator (Ciba-Geigy) | 4.0 gm |
| FC-430 (3M proprietary surfactant) | 0.1 gm |

After coating, cure was effected with a UV processor using two lamps at 200 W/inch and a single pass at 50 feet/minute. The final dry coating weight was varied by changing the rate of solution flow to the web. Thus, a photoreceptor was prepared with the organic photoconductor layer separated from the silicone polymer top-coat by an intermediate HHA barrier layer of 0.12 microns.

It was found that this barrier layer effectively eliminated response changes due to migration of toner solvent or plasticizers into the OPC layer when the photoreceptor was used in electrophotographic processes, particularly those involving liquid toning and/or thermal adhesive assisted image transfer steps. Photoreceptors prepared without this barrier layer developed detectable and permanent persistent images after one to four process cycles. In addition, the silicone top coating on the HHA interlayer contained no detectable BBCPM residue after thermal cure at 127° C. for five minutes.

Example 2

Polyvinylalcohol (PVA) was dissolved in a water/methanol mixture (30% methanol) to give a 0.8% by weight solution (solution A). Gantrez TM AN-139 resin was then dissolved in a water/methanol mixture (75% methanol) to give a 0.6% by weight solution (solution B). The pH of solution A was then adjusted to 4.5 by the addition of solution B to give a final solution C containing 93 parts by weight of PVA to 7 parts by weight of Gantrez TM AN-139 resin. This solution C was used to prepare the PVA/Gantrez (93/7) intermediate layer at a final dry coating thickness of about 0.05 micrometers. Photoreceptors containing this barrier layer between the OPC and silicone layers showed improvements in cycling stability similar to those of the HHA barrier coated photoreceptors described in Example 1.

The weight percent composition for the organic photoconductor layer used in obtaining the data shown in Table 1 was as follows: BBCPM (I) (40%) as the charge transport material, the heptamethine indocyanine dye (0.7%) as the spectral sensitizer and Vitel TM PE-207 polyester resin (Goodyear) (59.3%) as the polymeric binder. This composition was solvent coated onto an aluminized polyester substrate to give a final dry coating thickness of around ten micrometers. After drying, a thin intermediate layer (about 0.05 micrometers) was coated on the OPC layer before application of the low surface energy, silicone polymer top coat. In the case of the HHA layers, the material was coated as a monomer then UV polymerized by passing the coated web under a suitable source of irradiation. In all the examples listed in Table 1 the coating solvent was either ethanol, methanol or a water alcohol mixture.

The results tabulated below indicate the efficiency of various intermediate materials in protecting the OPC layers from (1) loss of charge transport material through its migration from the OPC into the release coat and (2) migration of plasticizing materials from the adhesive transfer film into the OPC. In the latter case, the major effect is on the spectral absorbance of the sensitizer since a reduced layer Tg leads to a more rapid degradation of the dye at raised temperatures. A reduced layer Tg also results in the softening of the OPC which may become susceptible to impaction of toner particles. Another undesirable characteristic of lower Tg layers results from the increased diffusion rates of molecular species which can lead to the effective loss of charge transport material from the OPC either by exudation or crystallization.

The charge transport material eluted from the construction by the Isopar TM G solvent comes from material which migrates into the silicone release layer during the thermal cure of this topcoat. The abrasion resistance, durability and release characteristics of the silicone polymer topcoat may be adversely affected by the presence of this liquid developer soluble material and, at least during the initial image cycles, problems related to toner flow off the imaged areas can also occur.

Experimentally, the results in Table 1 show the percent decrease in dye absorbance observed after heating an OPC construction in contact with a standard thermal adhesive film, as referred to in FN 44787USA6A, filed Apr. 18, 1990, for a period of ten minutes at 112° C. together with the quantity of charge transport material eluted from unit area of OPC during washing with Isopar TM G for 5 minutes.

TABLE 1

Efficiency of various intermediate layers as barriers to both liquid developer solvent and thermal adhesive film plasticizer migration.

| Interlayer material (polymer composition) | Elution of BBCPM (mg/sq. meter) | Change in dye absorbance (% loss) |
|---|---|---|
| None (standard OPC) | 20.0 | >90 |
| polyacrylamide | 1.0 | 4 |
| hydroxypropylcellulose | 0.4 | 65 |
| methylcellulose | 0.3 | 16 |
| polyvinylalcohol | <0.1 | 5 |
| methylvinylether/maleic anhydride copolymer | <0.1 | <2 |
| polyvinylpyrrolidone | 0.4 | 10 |
| polyvinylalcohol | <0.1 | 4 |

TABLE 1-continued

Efficiency of various intermediate layers as barriers to both liquid developer solvent and thermal adhesive film plasticizer migration.

| Interlayer material (polymer composition) | Elution of BBCPM (mg/sq. meter) | Change in dye absorbance (% loss) |
|---|---|---|
| (93 parts) + methylvinylether/maleic anhydride copolymer (7 parts) | | |
| HHA | <0.1 | 8 |

Aside from their efficiency as barrier layers, another important effect is that of ambient humidity on photoreceptor performance. Table 2 shows the effect of humidity on image resolution for several of the OPC constructions listed in Table 1. In generating the data presented in Table 2, the photoreceptor films were charged to 300 volts followed by contact exposure to a high contrast resolution target.

The "Gantrez" resin referenced in Table 2 is a methylvinylether/maleic anhydride copolymer commercially available from the GAF Corporation under the name Gantrez TM AN-139.

TABLE 2

Effect of relative humidity on the image resolution of photoreceptor constructions containing various intermediate layer materials.

| Interlayer Material | Temperature % RH | Temperature (°F.) | Resolution (lp/mm) |
|---|---|---|---|
| None | 37 | 72 | 40 |
| None | 48 | 77 | 43 |
| None | 63 | 74 | 38 |
| HHA | 37 | 72 | 43 |
| HHA | 63 | 74 | 42 |
| Gantrez TM | 37 | 72 | 42 |
| Gantrez TM | 48 | 77 | 5 |
| PVA | 37 | 72 | 40 |
| PVA | 63 | 74 | 4 |
| PVA/Gantrez TM (93/7) | 37 | 72 | 38 |
| PVA/Gantrez TM (93/7) | 48 | 77 | 20 |
| PVA/Gantrez TM (93/7) | 63 | 74 | 15 |

Table 2 indicates that neither PVA nor Gantrez would be desirable interlayer materials in imaging applications involving exposure to RH values in excess of 40% although, it should be noted, the PVA/Gantrez (93/7 mixture) interlayer showed a significantly greater resistance to humidity induced changes than did either material alone. The OPC constructions containing HHA barrier layers showed essentially unchanged resolution at RH values in excess of 60%. This lack of sensitivity to high ambient humidity allows the HHA interlayer materials to be coated at greater thicknesses than is preferable or desirable for the water soluble polymers. The efficiency of HHA as a barrier coat increases with the layer thickness, as indicated in Table 3 where the measured parameters have the same significance as in Table I.

TABLE 3

Barrier efficiency of HHA coats at various thicknesses.

| HHA interlayer thickness (microns) | Elution of BBCPM (mg/sq. meter) | Change in dye absorbance (% loss) |
|---|---|---|
| 0 | 20.0 | >90 |
| 0.05 | <0.1 | 8 |
| 0.12 | <0.1 | 3 |
| 0.20 | <0.1 | <2 |
| 0.50 | <0.1 | <2 |

We claim:

1. An organic photoconductor element for use in electrophotographic imaging comprising an organic photoconductive layer having on one surface thereof a barrier layer on said photoconductor layer and a release layer topcoat on said barrier layer, said barrier layer inhibiting the transport of material between said photoconductor layer and said release layer and said barrier layer comprising an organic polymeric film forming layer having a thickness of at least 0.02 micrometers and which barrier layer is of a different chemical composition than said release layer.

2. The element of claim 1 wherein said release layer comprises an organo-silicone polymeric layer.

3. The element of claim 1 wherein said barrier layer comprises a polar polymer which has a glass transition temperature higher than 40° C.

4. The element of claim 2 wherein said barrier layer comprises a polymer selected from the group consisting of acrylic polymers, vinyl resins, and cellulosic polymers.

5. The element of claim 3 wherein said barrier layer comprises a polymer selected from the group consisting of acrylic polymers, vinyl resins, and cellulosic polymers.

6. The element of claim 1 wherein said barrier layer comprises a polymer selected from the group consisting of acrylic polymers and vinyl resins wherein said polymers of said barrier layer are polar, have glass transition temperatures over 40° C., and are crosslinked.

7. The element of claim 3 wherein said barrier layer comprises a polymer selected from the group consisting of acrylic polymers and vinyl resins.

8. A process for generating an electrophotographic image comprising the steps of providing a charge on the element of claim 1, imagewise removing charge from said element, applying a liquid toner to said element after imagewise removal of charge so as to form an imagewise distribution of toner on said element, contacting said imagewise distribution of toner with a receptor surface and transferring said imagewise distribution of toner to said receptor surface.

9. A process for generating an electrophotographic image comprising the steps of providing a charge on the element of claim 2, imagewise removing charge from said element, applying a liquid toner to said element after imagewise removal of charge so as to form an imagewise distribution of toner on said element, contacting said imagewise distribution of toner with a receptor surface and transferring said imagewise distribution of toner to said receptor surface.

10. A process for generating an electrophotographic image comprising the steps of providing a charge on the element of claim 3, imagewise removing charge from said element, applying a liquid toner to said element after imagewise removal of charge so as to form an imagewise distribution of toner on said element, contacting said imagewise distribution of toner with a receptor surface and transferring said imagewise distribution of toner to said receptor surface.

11. A process for generating an electrophotographic image comprising the steps of providing a charge on the element of claim 4, imagewise removing charge from said element, applying a liquid toner to said element after imagewise removal of charge so as to form an imagewise distribution of toner on said element, contacting said imagewise distribution of toner with a receptor surface and transferring said imagewise distribution of toner to said receptor surface.

12. A process for generating an electrophotographic image comprising the steps of providing a charge on the element of claim 6, imagewise removing charge from said element, applying a liquid toner to said element after imagewise removal of charge so as to form an imagewise distribution of toner on said element, contacting said imagewise distribution of toner with a receptor surface and transferring said imagewise distribution of toner to said receptor surface.

13. A process for generating an electrophotographic image comprising the steps of providing a charge on the element of claim 7, imagewise removing charge from said element, applying a liquid toner to said element after imagewise removal of charge so as to form an imagewise distribution of toner on said element, contacting said imagewise distribution of toner with a receptor surface and transferring said imagewise distribution of toner to said receptor surface.

14. An organic photoconductor element for use in electrophotographic imaging comprising an organic photoconductive layer having on one surface thereof a barrier layer on said photoconductor layer comprising a polymer selected from the group consisting of acrylic polymers and cellulosic polymers and a release layer topcoat on said barrier layer, said barrier layer comprising an organic polymeric film forming layer having a thickness of at least 0.02 micrometers and is of a different chemical composition than said release layer.

15. The element of claim 14 wherein said release layer consists of an organo-silicone polymeric layer.

16. The element of claim 14 wherein said barrier layer has transition temperature greater than 40° C., a degree of crosslinking in excess of 1.01, polarity, and a solubility in water, alcohol, or water/alcohol mixtures of at least 0.1% by weight.

17. An organic photoconductor element for use in electrophotographic imaging comprising an organic photoconductive layer having on one surface thereof a barrier layer on said photoconductor layer and a release layer topcoat on said barrier layer, said barrier layer inhibiting the transport of material between said photoconductor layer and said release layer and said barrier layer comprising an organic polymeric film forming layer having a thickness of at least 0.02 micrometers and which barrier layer is of a different chemical composition than said release layer, said barrier layer comprising a polymer having polarity, a glass transition temperature greater than 40° C., and a degree of crosslinking in excess of 1.01.

18. The element of claim 17 wherein said barrier layer comprises a polymer selected from the group consisting of acrylic polymers, vinyl resins, and cellulosic polymers.

19. An organic photoconductor element for use in electrophotographic imaging comprising an organic photoconductive layer having on one surface thereof a barrier layer on said photoconductor layer and a release layer topcoat on said barrier layer, said barrier layer comprising an organic polymeric film forming layer having a thickness of at least 0.02 micrometers and is of a different chemical composition than said release layer.

* * * * *